United States Patent [19]

Pullen et al.

[11] 4,356,080

[45] Oct. 26, 1982

[54] SOLVENT DEOILING APPARATUS AND PROCESS

[75] Inventors: Edward A. Pullen, Fullerton; Thomas Hallis, Jr., Brea, both of Calif.

[73] Assignee: Union Oil Company of California, Los Angeles, Calif.

[21] Appl. No.: 48,133

[22] Filed: Jun. 13, 1979

Related U.S. Application Data

[63] Continuation of Ser. No. 848,746, Nov. 4, 1977, abandoned.

[51] Int. Cl.[3] ..... C10G 73/06

[52] U.S. Cl. ..... 208/31; 208/33

[58] Field of Search ..... 208/31, 33

[56] References Cited

U.S. PATENT DOCUMENTS

| | | | |
|---|---|---|---|
| 2,229,658 | 1/1941 | Jenkins | 208/31 |
| 2,265,139 | 12/1941 | Brandt | 208/31 |
| 2,783,183 | 2/1957 | Ferris | 208/31 |
| 3,108,943 | 10/1963 | McDaniel | 208/31 |
| 3,159,563 | 12/1964 | Anastasoff et al. | 208/31 |
| 3,642,609 | 2/1972 | Mayer et al. | 208/33 |

*Primary Examiner*—Delbert E. Gantz
*Assistant Examiner*—William Leader
*Attorney, Agent, or Firm*—Gregory F. Wirzbicki; Dean Sandford

[57] ABSTRACT

In solvent deoiling of slack waxes utilizing conventional multi-stage, scraped chillers, solvent is injected into conduits transporting slack wax slurry from one scraped chiller to the next through high velocity jet nozzles.

34 Claims, 2 Drawing Figures

SOLVENT DEOILING APPARATUS AND PROCESS

CROSS-REFERENCE TO RELATED APPLICATIONS

This application is a continuation of Ser. No. 848,746, filed Nov. 4, 1977, now abandoned.

BACKGROUND OF THE INVENTION

This invention relates to an improvement in a conventional process for deoiling slack waxes obtained from dewaxing petroleum lubricating oil feedstocks.

Slack waxes obtained from refining petroleum lubricating oils consist of about 25 wt.% oil, 25 wt.% soft wax having a melting temperature below about 120° F., and about 50 wt.% hard wax having a melting temperature between about 120° and 170° F. In most petroleum refineries, such slack waxes are conventionally treated so as to produce a fully refined petroleum wax (i.e., a wax containing less than 0.5 wt.% oil) and a mixture of soft wax and oil, commonly termed "foots oil". Both the fully refined petroleum wax and the foots oil so produced are marketable products.

One accepted method by which slack waxes are converted to foots oil and fully refined petroleum wax is by blending a solvent, such as methylisobutyl ketone or a blend of methylethyl ketone and toluene, with the slack wax, then heating the slack wax-solvent blend to a temperature at which the slack wax and solvent are miscible, and, finally, passing the resultant heated liquid through a series of concentric, double-piped scraped chillers. In the chillers, this liquid, which is a solution of molten wax, oil, and solvent, is cooled at a rate between about 1° and 10° F./min. to a final temperature between about 20° and 85° F. During chilling, wax crystals deposit on the walls of an inner pipe of the chillers while the rotating scrapers within the chillers gently remove the deposited wax from the inner pipe surface, thereby producing a slurry containing wax crystals. This slurry gradually increases in wax crystal content as it is passed from one chiller to the next, and, ultimately, a product slurry is recovered from the last chiller, which slurry is then separated into a fully refined petroleum wax, foots oil, and solvent by filtration and conventional solvent recovery techniques.

A recognized improvement over the foregoing, which substantially reduces both the energy input requirements for each chiller and the amount of solvent required during chilling, is the incremental dilution method. According to this method, the slack wax is fed into the scraped chiller system and is chilled until some wax crystallization occurs. The first increment of solvent is then introduced at this point, with the rate at which the solvent is introduced being only that necessary to maintain fluidity of the wax-oil-solvent slurry formed by the introduction of the first increment of solvent. Cooling continues as the slurry travels further through the chiller system. When the slurry is again about to become too thickened for movement, a second increment of solvent is introduced, again at a rate sufficient to maintan fluidity of the slurry. Similar incremental additions of solvent are made at various points along the chilling apparatus, and by the time the product slurry is obtained from the final chiller, it is found that less than 50% of the solvent is needed to produce the same product slurry as would have been required if the solvent and slack wax feed had been completely blended before passage through the chiller system. As should be apparent, therefore, since less solvent is passed through the chillers, and then only on an incremental basis, the energy load on each chiller is substantially reduced since the mass flow of slurry processed therethrough is much lower.

However, despite the extensive use of the incremental dilution process, several difficulties remain. Chief among these is that each increment of solvent is added at the same temperature as the slurry stream into which it is introduced. (Normally, if the temperature were lower, shock chilling with attendant formation of difficultly filterable, amorphous wax would result; if the temperature were higher, then energy would be wasted due to the extra energy load put on the chillers.) Hence, because the solvent is recovered from the filtration step at a temperature (herein termed the filtration temperature) below that at which any of the incremental streams of solvent is added, the solvent must be heated before being recycled to the process. This, of course, involves a waste of heat energy inasmuch as each incremental stream of solvent is heated only to be subsequently cooled as a component of the slurry passing through the chillers. Moreover, because the slurry is gradually reduced in temperature by the chillers, in order for each incremental addition of solvent to be at the same temperature as the slurry into which it is introduced requires dividing the solvent obtained from the filtration step into streams which must be individually heated to different temperatures. But to provide means for heating each solvent stream to a different temperature imposes a considerable control problem on one designing a scraped chiller system for the incremental dilution process.

Various attempts to improve upon the incremental dilution technique, primarily by adding solvent at the filtration temperature and thus attempting to live with the effects of shock chilling, have met with mixed results. For example, in one known process a single globe valve is situated in the chilling apparatus, usually at or near a point where the slurry would be at a temperature half-way between the temperature of the molten slack wax feedstock (i.e., 120°–200° F.) and the product slurry (i.e., 20°–85° F.). The opening through the globe valve is restrictive in nature, and when solvent is incrementally introduced at a temperature lower than that of the slurry, it has been found that the wax formed by shock chilling is broken up by passage through the globe valve. Since almost all wax formed by shock chilling occurs in the first few chillers, the restrictive opening of the globe valve insures that none of the gummy lumps formed by shock chilling appears in the product slurry.

Although the use of a globe valve or the like offsets the effects of shock chilling with respect to the wax ultimately filtered, there are problems with its use. First, it has proven ineffective in producing an easily filterable wax when a slack wax of high melting temperature, such as a 165 slack wax, is treated. Evidently, for such slack waxes the temperature differential between the added solvent and the slurry downstream of the globe valve is such that some shock chilling occurs downstream of the globe valve. Second, high operating pressures are normally required when the globe valve is utilized because the restricted opening therein substantially increases the pressure drop across the chilling system. And lastly, some of the gummy wax produced upstream of the globe valve by shock chilling accumulates within the chillers in which it is formed. This, of course, aggravates the pressure drop problem already caused by the globe valve itself, and, as a result, frequent "steaming" of the chillers (i.e., passing heated solvent by itself through the chillers to dissolve the gummay deposits) proves necessary.

Hence, in view of the foregoing, it is apparent that an improvement to the incremental dilution method is needed so that solvent can be added at the filtration temperature without the detrimental effects of shock chilling. Heretofore, it has been assumed that shock chilling in the incremental dilution process is caused solely by the temperature difference between the added solvent and the slurry. For example, in U.S. Pat. Nos. 3,642,609, 3,775,288, and 3,871,991, methods involving "dilution chilling" in a large tower are taught to be useful in dewaxing operations, at least in part because it has been "repeatedly demonstrated" that adding solvent to warmer slurry in the incremental dilution process causes shock chilling. But it has now been found that shock chilling in this process is caused by the combined effects of (1) introducing cold solvent into the warmer slurry and (2) poor mixing of the added solvent with the slurry, i.e., at the point of solvent introduction the mixing is non-uniform and incomplete. Thus, it is a specific object of the invention to improve the incremental dilution process by providing for instantaneous and uniform mixing of solvent and slurry, thereby avoiding the effects of, and problems associated with, shock chilling.

SUMMARY OF THE INVENTION

In accordance with this invention, the incremental dilution deoiling process as described hereinabove is improved by adding each increment of solvent to the slurry passing between chillers through a jet nozzle. The use of jet nozzles insures that each increment of solvent is mixed in a highly turbulent zone such that, for all practical purposes, the resultant mixing of solvent and slurry is accomplished uniformly and instantaneously. In so doing, it has been found that no shock chilling results, and the problems associated with shock chilling are therefore eliminated.

BRIEF DESCRIPTION OF DRAWING

Apparatus components appearing in both FIGS. 1 and 2 are designated by the same reference numeral.

DETAILED DESCRIPTION OF THE INVENTION

This invention is designed to treat oil-containing waxes so as to produce an essentially oil-free, fully refined petroleum wax. Especially contemplated waxy feedstocks are slack waxes obtained from dewaxing lubricating oils. Since fully refined petroleum waxes obtainable from slack waxes have melting points varying in the 100° to 200° F. range, a slack wax is graded by the melting temperature of the fully refined petroleum wax ultimately produced therefrom. For example, a 165 slack wax is one from which a fully refined petroleum wax having a melting temperature of 165° F. is obtainable, said melting temperature being determined herein, as is customary in the art, by ASTM test method D938-71, entitled "Standard Method of Test For Congealing Point of Petroleum Waxes, Including Petrolatum". The invention in the preferred embodiment now to be described is most especially designed to treat slack waxes from which a fully refined petroleum wax having a melting temperature between 120° and 170° F. by ASTM test method D938-71 is obtained.

Figure 1:
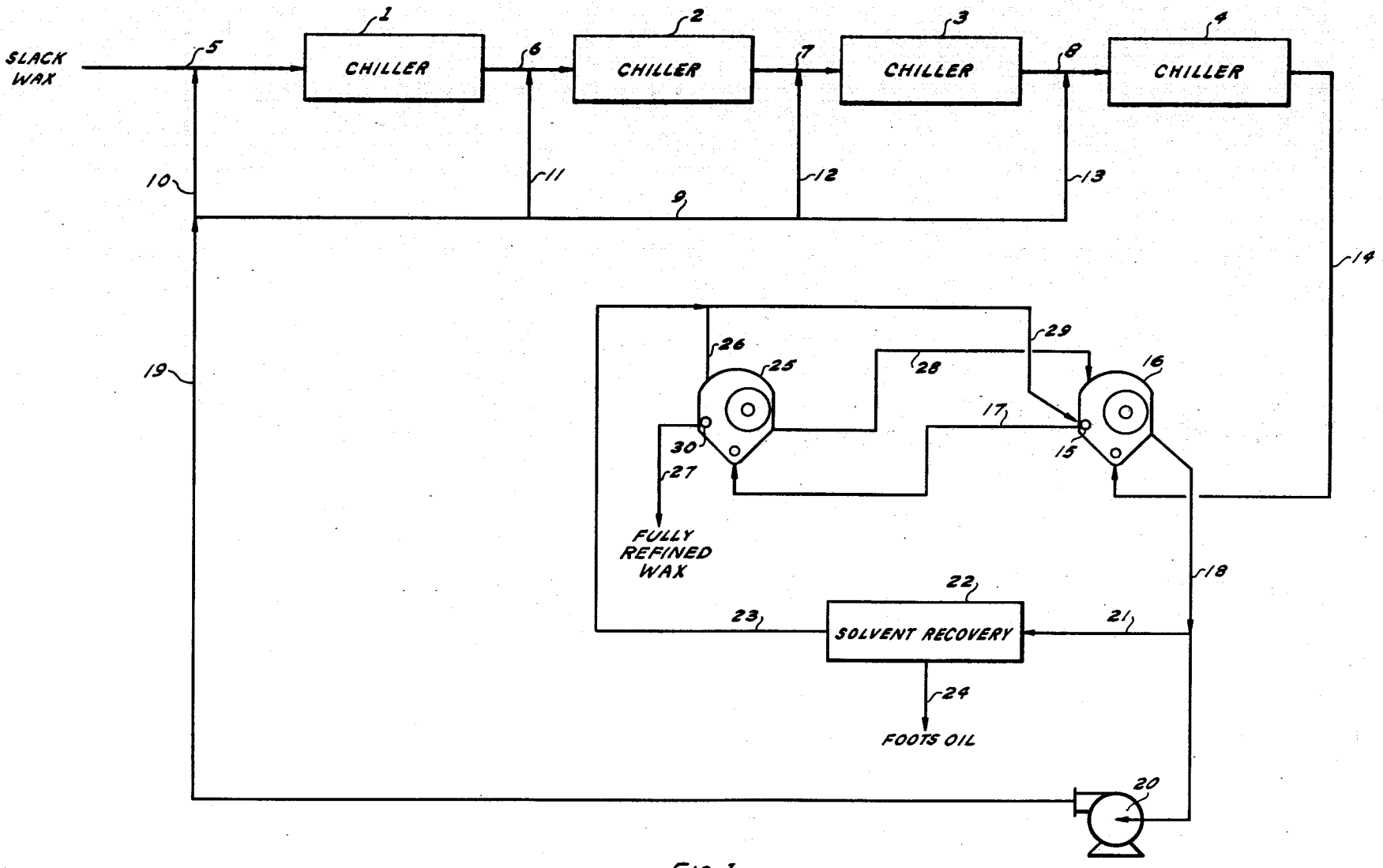
FIG. 1 of the drawing shows in schematic diagram form the preferred embodiment of the invention.

Referring now to FIG. 1 of the drawing, four conventional chillers, 1, 2, 3, and 4 for deoiling slack waxes are serially connected by pipe conduits 5, 6, 7, and 8. The chillers are preferably of the double pipe, scraped surface variety comprising two concentrically-situated, straight pipes and a rotatable scraper housed within the interior pipe for scraping wax crystals off the inner surface of the interior pipe.

In operation, a slack wax of high melting temperature, either alone or blended with sufficient solvent from line 10 to maintain fluidity, is fed via line 5 to the first chiller 1. The slack wax or slack wax-solvent blend enters the inner pipe of chiller 1 and is cooled at a rate of about 1° to 10° F./min., preferably 1° to 5° F./min., by a liquid refrigerant passed through the annulus defined by the inner and outer pipes of the chiller. During chilling, wax crystals first separate from the mother liquor by depositing on the inner surface of the inner pipe and are then scraped off by the action of the rotating scraper, thereby producing a solid wax-containing slurry that is gradually forced out of chiller 1 into line 6.

The slurry in line 6 is thickened and must be blended with more solvent if it is to remain a slurry. Hence, solvent is introduced from header 9 through line 11 at a rate sufficient to maintain the fluidity of the slurry entering chiller 2. Suitable solvents fed through header 9 comprise at least 50 wt.% of organic liquids selected from the class consisting of methylisobutyl ketone, methylethyl ketone, methylpropyl ketone, and mixtures of methylethyl ketone with toluene, methylisobutyl ketone, or methylpropyl ketone. The preferred solvent, however, is methylisobutyl ketone.

The slurry-solvent blend produced in line 6 is fed into chiller 2 wherein further cooling is accomplished in a manner similar to that described above for chiller 1. The product obtained from chiller 2 is blended in line 7 with solvent from line 12, said solvent being blended at a rate sufficient to maintain fluidity of the slurry into which it is introduced. The slurry is then serially fed to one or more chillers in a manner as just described for chillers 1 and 2, but for convenience only the final chillers 3 and 4 and solvent injection line 13 are shown in the drawing. The exact number of chillers required in any particular application, of course, will depend upon a number of factors, including the solvent utilized, the heat capacity of the refrigerant, the final filtration temperature, and the mass flow rate of the slack wax feedstock. Taking these factors into account, it will usually be found that between about 10 and 20 chillers will be necessary in commercial practice if the system is to be used to treat all grades of slack wax.

The product slurry obtained in line 14 is at a temperature between about 20° and 85° F., the exact temperature being dependent upon the proportion of soft wax desired in the fully refined petroleum wax ultimately obtained in line 27 by filtration, with increasingly lower temperatures of the product slurry yielding a petroleum wax in line 27 containing increasingly more soft wax. The product slurry is introduced into primary filter 16, which is preferably of the conventional, rotary vacuum variety, and a separation of partially refined, highly viscous petroleum wax from a liquid comprising foots oil is effected. Thus, the product slurry is separated into (1) a filter cake consisting essentially of a partially refined petroleum wax gathered by screw conveyor 15 integral with the primary filter 16 and (2) a liquid stream, commonly called the primary filtrate, pumped through line 18. The primary filtrate, consisting of solvent and foots oil, is in part directed by lines 18 and 19 and pump 20 to header 9 for use as the solvent added incrementally to the molten slack wax in line 5 and the slurry in lines 6, 7, and 8 as hereinbefore described. Another portion of the primary filtrate, however, is fed through line 21 to conventional solvent recovery facilities 22 wherein solvent is recovered via line 23, thereby leaving a foots oil product in line 24.

The partially refined wax in screw conveyor 15 is blended with solvent from line 29 and the slurry stream so formed is passed via line 17 to a secondary vacuum rotary filter 25 of design similar to that of primary filter 16. In the secondary filter, solvent from line 26 is utilized as a wash to aid in separating the slurry stream into a fully refined petroleum wax obtained in conduit 27 from screw conveyor 30 and a secondary filtrate consisting of oil and soft wax, which is recycled by line 28 to the primary filter 16 for use therein as a wash solvent. The fully refined petroleum wax in line 27 contains less than 0.5 weight percent oil, preferably less than 0.3 weight percent oil, and is a marketable product.

It will be noted in the foregoing description of the invention that no means have been described for heating the primary filtrate in line 19 prior to its incremental addition via lines 10, 11, 12, and 13. Although it is normally considered necessary in the prior art to prevent shock chilling by adding the solvent at a temperature equivalent to that of the slack wax stream or slurry stream into which it is injected, it has been found in the practice of the invention that shock chilling is avoided by mixing the incrementally added solvent under highly turbulent conditions. Thus, it is a critical feature of the invention that the addition of solvent via lines 10, 11, 12, and 13 be accomplished under conditions of high agitation, such as by incrementally adding solvent by means of a jet nozzle. When solvent is added in this manner, it may be added at any desired temperature, preferably at the temperature at which it is recovered from the primary filter 16, i.e., usually between about 20° and 85° F.

Figure 2:
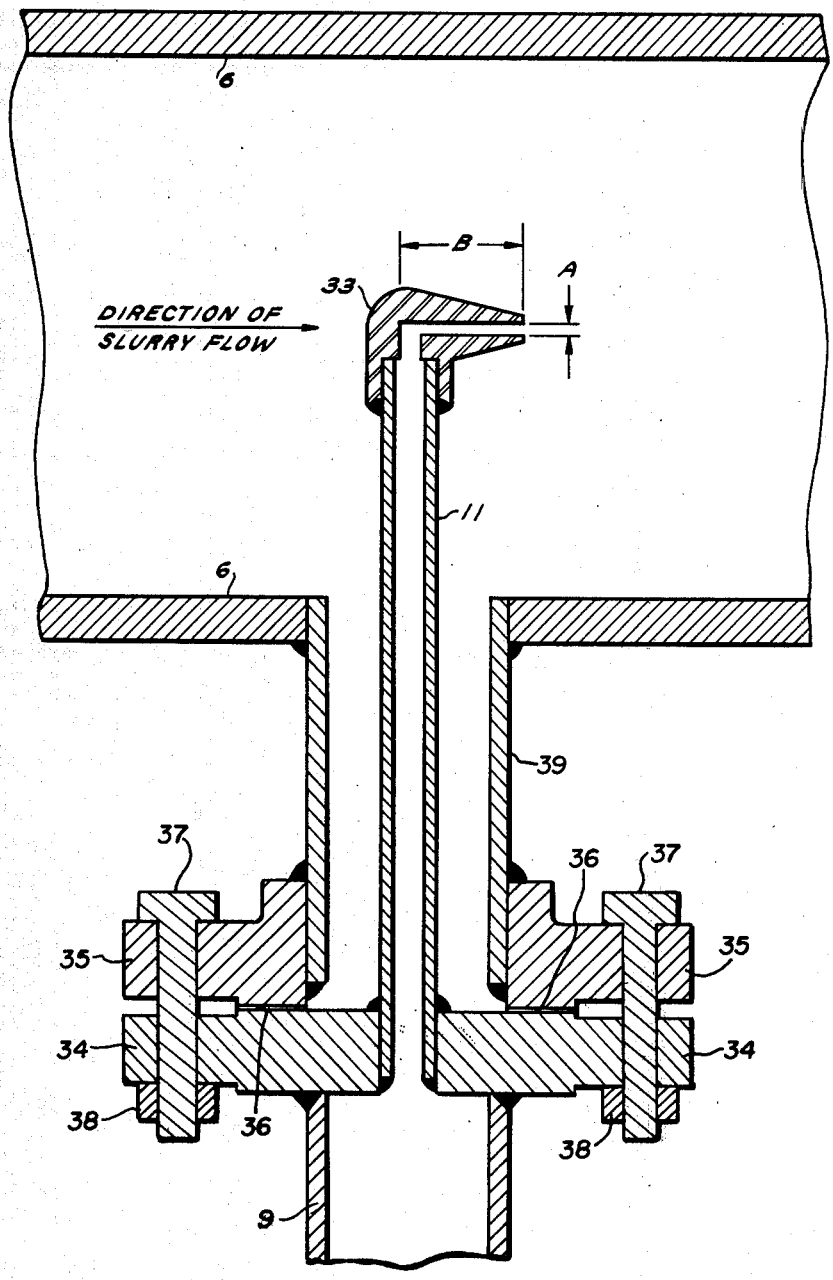
FIG. 2 shows a nozzle installed in a pipe conduit, such as that designated by reference numeral 6 in FIG. 1, for injecting solvent from line 11 of FIG. 1 in accordance with the preferred embodiment of the invention.

The preferred method by which solvent is incrementally added will be more readily understood by reference to FIG. 2 of the drawing wherein pipe 11 is fitted with a jet nozzle 33 for delivering solvent from line 11 into the center of a wax slurry stream carried in pipe 6. The nozzles may be of varying design, but for most commercial applications it will usually be found that suitable nozzles will be of a design such that the diameter A of the nozzle orifice will be between about ⅛" and ⅜" in diameter, or, if the orifice is not circular, between about 0.01 and 0.15 $in^2$ in area. Also, to reduce the pressure drop through the nozzles as much as possible, the length B of the orifice is preferably between about 0.25 and 2.0 inch; however, the use of nozzles having larger orifice lengths is also within the scope of the invention.

Nozzle 33 and pipe 11 are situated within pipe conduit 6 by any convenient means. For example, as shown in FIG. 2, pipe 11 may be welded to flange 34, which in turn is welded to a pipe connector forming a part of manifold header 9, thereby allowing for fluid communication between header 9 and pipe 11. To provide a fluid-tight seal, pipe 39 surrounding pipe 11 is welded to pipe 6 and flange 35. Flange 35 is then mounted against flange 34 by bolts 37 and nuts 38, with gasket 36 providing the fluid tight seal.

In order to insure that solvent injected through nozzle 33 is turbulently mixed with the wax slurry, solvent is usually passed therethrough at a linear velocity of at least 100 feet per second, preferably at least 150 feet per second, and most preferably between about 200 and 1000 feet per second. Accordingly, the overall system must be designed such that pump 20 delivers sufficient solvent through each of the nozzles to maintain fluidity at the point of injection and also to insure that the solvent so delivered is done at a rate sufficient to insure turbulent mixing. Thus, proper design of the system used in any particular application must take into account such factors as number of nozzles, pressure drop through each, the pressure generated by pump 20, etc.

Although for convenience purposes the number of solvent injection points shown in FIG. 1 of the drawing is equal to the number of chillers, such is not necessary for successful operation. Preferably, the number of nozzles used to inject solvent is one for about every 10°–30° F. temperature drop expected between the temperature of the initial heated slack wax in line 5 and the temperature of the wax slurry obtained from the final chiller in line 14. According to this formula, it will usually be found in commercial practice that a typical chilling unit will contain 10 to 20 chillers and about 5 to 15 jet injector nozzles. It is, however, within the scope of the invention to use as many jet nozzles as desired in a given chilling system, provided that the number be so correlated with the feed rate and pressure of solvent passing through each nozzle and with the design of the nozzles themselves that all solvent is mixed under turbulent conditions with the slurry or slack wax into which it is injected.

In an alternative embodiment of the invention, rather than providing a single nozzle between chillers, as is preferred, several nozzles are installed so that mixing is accomplished under extremely high turbulent conditions. In one such embodiment, a plurality of nozzles is arranged in a ring about the pipe conduit carrying the slack wax slurry such that solvent is injected into the slurry stream from several directions at once. In another embodiment, a series of nozzles, each mounted in the pipe conduit in a fashion as shown in FIG. 2, is utilized to produce a continuous zone of turbulent mixing as the wax slurry moves from one chiller to the next. These and other such embodiments or modifications providing for a mixing zone of high turbulence are suitable alternatives to the preferred embodiment.

The following example is provided to illustrate the preferred embodiment of the invention.

EXAMPLE

A wax deoiling system as schematically shown in FIG. 1 was constructed to comprise a chilling apparatus including (a) fifteen double-piped, scraped surface chillers, each having an inner pipe of 12-inch I.D., and (b) eight solvent injection nozzles, each being set, in a fashion as shown in FIG. 2, in 12-inch I.D. pipe conduits carrying wax slurry from the first, third, fifth, sixth, eighth, tenth, twelfth, and fourteenth chillers, said nozzles being of orifice diameter equal to 0.166 inch and orifice length equal to 1.25 inch. This chilling apparatus, in conjunction with conventional primary and secondary vacuum rotary filters, was used to deoil a variety of slack waxes of grades 125, 143, and 165. These slack waxes were fed into the chilling apparatus at a temperature in the range of 120°–175° F. and at a rate in the range of 750–1500 barrels per day. The solvent utilized comprised at least 50% methylisobutyl ketone(the remainder being largely foots oil), which was fed through each nozzle at a pressure between about 400 and 500 psig and at a rate between about 100 and 300 barrels per day. The temperature of injected solvent was the same as the final filtration temperature, usually between about 20° and 85° F.

It was found with all such feedstocks that the wax deoiling system as described was useful for delivering a superior fully refined petroleum wax product that consistently contained less than 0.3 wt.% oil. This compares favorably to the oil content of fully refined petroleum waxes produced from conventional chilling systems, which usually fall in the range of 0.35–0.40 wt.% oil.

In addition to the foregoing, the following advantages were found to inhere in the process of the invention utilizing the chilling apparatus just described: (1) the fully refined petroleum wax filter cakes produced in the primary and secondary filters were free of gummy lumps, thereby demonstrating that no shock chilling had occurred; (2) control problems relative to introducing separate incremental streams of solvent at different temperatures were eliminated; (3) energy input requirements for the overall process were substantially reduced, not only because the solvent was not heated above the filtration temperature, but also because the introduction of solvent at a temperature lower than that of the slurry reduces the load on the chillers; and (4) frequent "steaming" with attendant downtime of the chilling unit was not found necessary; instead, an occasional "hot shot" treatment, i.e., operating for a short period of time with the solvent injected into the slack wax slurry at temperatures above 100° F. was all that was required to bring the pressure drop, which in operation increases due to wax accumulation in the chillers, back to normal.

Although the invention has been described in conjunction with specific embodiments and an example thereof, it is evident that many alternatives and variations will be apparent to those skilled in the art in light of the foregoing description. Accordingly, it is intended to embrace all such alternatives and variations that fall within the spirit and scope of the appended claims.

We claim:

1. In a solvent deoiling process wherein an oil-containing wax feedstock is passed through a series of scraped chillers to produce a product slurry containing crystallized wax that is subsequently separated from said oil to produce a fully refined petroleum wax, and wherein the solvent is added incrementally into conduits carrying wax slurry from one chiller to the next, the improvement comprising injecting incrementally added solvent directly into a plurality of said conduits at linear velocities producing within each conduit of said plurality a turbulent mixing zone, said turbulent mixing zones being of sufficiently high agitation such that substantially uniform and instantaneous mixing of said solvent and the wax slurry into which it is injected is effected.

2. A process as defined in claim 1 wherein solvent injected into at least one of said turbulent mixing zones is at a temperature below that of the wax slurry into which it is injected.

3. A process as defined in claim 1 wherein solvent is injected into a plurality of said turbulent mixing zones at a temperature substantially below that of the wax slurry into which it is injected.

4. In a solvent deoiling process wherein a slack wax feedstock is passed through a series of scraped chillers to produce a product slurry containing crystallized wax that is subsequently removed by filtration, wherefrom a fully refined petroleum wax is obtained, and wherein the solvent is added incrementally into pipe conduits carrying wax slurry from one chiller to the next, the improvement comprising injecting incrementally added solvent into a plurality of said conduits by means of jet nozzles at linear velocities producing turbulent mixing zones having sufficiently high agitation such that substantially uniform and instantaneous mixing of said injected solvent and the wax slurry into which it is injected is effected.

5. A process as defined in claim 4 wherein said solvent is selected from the group consisting of methylethyl ketone, methylethyl ketone and methylisobutyl ketone, methylethyl ketone and toluene, methylisobutyl ketone, methylpropyl ketone, and methylethyl ketone and methylpropyl ketone.

6. A process as defined in claim 4 wherein the temperature of the injected solvent is at the final filtration temperature.

7. A process as defined in claim 4 wherein the number of incremental additions of solvent to be performed by jet injection mixing is one for between about every 10° to 30° F. temperature drop between the temperature of said slack wax feedstock entering the first chiller and the temperature of the slurry obtained from the final chiller.

8. A process as defined in claim 4 wherein said solvent is injected through each nozzle at a linear velocity of at least 100 feet per second, each of said nozzles having an orifice diameter between about $\frac{1}{8}$ inch and $\frac{3}{8}$ inch.

9. A process as defined in claim 4 wherein a plurality of jet nozzles is utilized to inject said solvent into each of said pipe conduits carrying said wax slurry from one chiller to the next.

10. A process as defined in claim 9 wherein said plurality of nozzles is arranged, in at least one of said pipe conduits, in a ring such that solvent is injected into said wax slurry from several directions at once.

11. A process as defined in claim 4 wherein said feedstock is passed through between about 10 and 20 chillers and wherein between about 5 and 15 jet nozzles are utilized to inject said solvent.

12. In a solvent deoiling process wherein an oil-containing wax feedstock is passed through a series of scraped chillers to produce a product slurry containing crystallized wax that is subsequently removed by filtration, wherefrom a fully refined petroleum wax is obtained, and wherein the solvent is added incrementally into pipe conduits carrying wax slurry from one chiller to the next, the improvement comprising injecting incrementally added solvent into a plurality of said pipe conduits by means of jet nozzles at linear velocities sufficient to produce within each conduit of said plurality of conduits a turbulent mixing zone such that substantially uniform and instantaneous mixing of said solvent and said wax slurry is effected, with said injected solvent passing through at least some of said nozzles at a temperature below that of the wax slurry into which it is injected.

13. A process as defined in claim 12 wherein said solvent is selected from the group consisting of methylethyl ketone, methylethyl ketone and methylisobutyl ketone, methylethyl ketone and toluene, methylisobutyl ketone, methylpropyl ketone, and methylethyl ketone and methylpropyl ketone.

14. A process as defined in claim 12 wherein said oil-containing wax feedstock is a 165 slack wax.

15. A process as defined in claim 12 wherein the number of incremental additions of solvent to be performed by jet injection mixing is one for between about every 10° to 30° F. temperature drop between the temperature of said oil containing wax feedstock entering the first chiller and the temperature of the slurry obtained from the final chiller.

16. A process as defined in claim 12 wherein said solvent is injected through each nozzle at a linear velocity of at least 100 feet per second, each of said nozzles having an orifice diameter between about $\frac{1}{8}$ inch and $\frac{3}{8}$ inch.

17. A process as defined in claim 12 wherein a plurality of jet nozzles is utilized to inject said solvent into each of said pipe conduits carrying said wax slurry from one chiller to the next.

18. A process as defined in claim 17 wherein said plurality of nozzles is arranged, in at least one of said pipe conduits, in a ring such that solvent is injected into said wax slurry from several directions at once.

19. A process as defined in claim 12 wherein said feedstock is passed through between about 10 and 20 chillers and wherein between about 5 and 15 jet nozzles are utilized to inject said solvent.

20. A process as defined in claim 12 or 16 wherein injected solvent passing through at least one of said jet nozzles is at a temperature substantially below that of the wax slurry into which it is injected.

21. A process as defined in claim 13, 14, or 16 wherein injected solvent passes through a plurality of said jet nozzles at a temperature substantially below that of the wax slurry into which it is injected.

22. In a solvent deoiling process wherein a slack wax feedstock is passed through a series of scraped chillers to produce a product slurry containing crystallized wax that is subsequently removed by filtration, wherefrom a fully refined petroleum wax is obtained, and wherein the solvent is added incrementally into pipe conduits carrying wax slurry from one chiller to the next, the improvement comprising injecting incrementally added solvent by means of jet nozzles, at least one of which jet nozzles is situated in each of said conduits between chillers into which solvent is incrementally added, said solvent being injected through each of said jet nozzles at linear velocities producing within said conduits a zone of sufficient turbulence such that substantially uniform and instantaneous mixing of said solvent and said wax slurry into which it is injected is effected, and said solvent being further injected, through at least most of said jet nozzles, at a temperature less than that of the wax slurry at each point of solvent injection.

23. A process as defined in claim 22 wherein said solvent is injected through all of said jet nozzles at a temperature substantially less than that of the wax slurry at each point of solvent injection.

24. In a solvent deoiling process wherein a slack wax feedstock is passed through a series of scraped chillers to produce a product slurry containing crystallized wax that is subsequently removed by filtration, wherefrom a fully refined petroleum wax is obtained, and wherein the solvent is added incrementally into pipe conduits carrying wax slurry from one chiller to the next, the improvement comprising injecting an incremental addition of solvent into at least one of the pipe conduits by means of a jet nozzle at a linear velocity of at least 100 feet per second.

25. A process as defined in claim 24 wherein a plurality of incremental additions of solvent are injected by means of jet nozzles at a linear velocity of at least 100 feet per second, and wherein at least some of the incremental additions passing through said jet nozzles are at a temperature substantially lower than the wax slurry into which it is injected.

26. A process as defined in claim 25 wherein the linear velocity of solvent passing through at least some of said jet nozzles is at least 150 feet per second.

27. In a solvent deoiling process wherein an oil-containing wax feedstock is passed through a series of scraped chillers to produce a product slurry containing crystallized wax that is subsequently removed by filtration, wherefrom a fully refined petroleum wax is obtained, and wherein solvent is added incrementally into pipe conduits carrying wax slurry from one chiller to the next, the improvement consisting essentially of the injection of incrementally added solvent into pipe conduits between scraped chillers by means of jet nozzles at linear velocities sufficient to produce within each conduit wherein solvent is injected by a jet nozzle a turbulent mixing zone such that substantially uniform and instantaneous mixing of said solvent and said wax slurry is effected.

28. A process as defined in claim 27 wherein the solvent injected through at least one of said jet nozzles is at a temperature substantially below that of the wax slurry stream into which it is injected.

29. A process as defined in claim 27 wherein the solvent injected through at least one of said jet nozzles is at a temperature below that of the wax slurry stream into which it is injected.

30. In a process for separating oil and wax by passage of a feedstock containing oil and wax through a series of scraped chillers to produce a product slurry containing crystallized wax, and wherein solvent is added incrementally into pipe conduits carrying wax slurry from one chiller to the next, the improvement comprising injecting incrementally added solvent into a plurality of said pipe conduits through one or more jet nozzles at a linear velocity of at least 100 ft./sec.

31. A process as defined in claim 30 wherein solvent passes through at least one jet nozzle at a linear velocity of at least 150 feet per second.

32. A process as defined in claim 31 wherein solvent passes through said one jet nozzle at a temperature below that of the wax slurry into which it is injected.

33. In a process for separating oil and wax by passage of a feedstock containing oil and wax through a series of scraped chillers to produce a product slurry containing crystallized wax, and wherein solvent is added incrementally into pipe conduits carrying wax slurry from one chiller to the next, the improvement comprising injecting incrementally added solvent into at least one conduit transporting wax slurry from one chiller to the next at linear velocities producing a turbulent mixing zone such that substantially uniform and instantaneous mixing of said injected solvent and said wax slurry is effected.

34. A process as defined in claim 30 or 33 wherein the injected solvent is at a temperature below that of the wax slurry into which it is injected.

* * * * *